US007013800B2

(12) United States Patent
Kanamaru et al.

(10) Patent No.: US 7,013,800 B2
(45) Date of Patent: Mar. 21, 2006

(54) MECHANICAL PRESS

(75) Inventors: Hisanobu Kanamaru, Kanagawa (JP); Takao Ito, Kanagawa (JP)

(73) Assignee: Aida Engineering Co., Ltd, Kanagawa (JP)

( * ) Notice: Subject to any disclaimer, the term of this patent is extended or adjusted under 35 U.S.C. 154(b) by 0 days.

(21) Appl. No.: 10/631,419

(22) Filed: Jul. 30, 2003

(65) Prior Publication Data

US 2005/0022679 A1 Feb. 3, 2005

(51) Int. Cl.
*B30B 1/26* (2006.01)

(52) U.S. Cl. ..... 100/257; 384/38; 74/44

(58) Field of Classification Search ..... 100/256, 100/257, 258 R, 280, 258 A, 269.17; 72/441, 72/452.1, 452.5, 446, 452.7, 455, 448; 83/527, 83/530; 74/44, 586; 384/16, 24, 32, 42, 384/26, 38, 39, 40, 41
See application file for complete search history.

(56) References Cited

U.S. PATENT DOCUMENTS

| | | | | |
|---|---|---|---|---|
| 2,984,175 A | * | 5/1961 | Wahl | 100/257 |
| 4,033,252 A | * | 7/1977 | Baker | 100/99 |
| 5,609,056 A | * | 3/1997 | Seeber | 72/446 |
| 5,761,971 A | * | 6/1998 | Brewer et al. | 74/586 |
| 6,764,218 B1 | * | 7/2004 | Kanamaru et al. | 384/38 |

FOREIGN PATENT DOCUMENTS

| | | |
|---|---|---|
| JP | 55-48500 | 4/1980 |
| JP | 57-014499 | 1/1982 |
| JP | 06-269996 | 9/1994 |

OTHER PUBLICATIONS

Patent Abstracts of Japan for JP55-048500 published on Apil 7, 1980.
Patent Abstracts of Japan for JP06-269996 published on Sep. 27, 1994.
Patent Abstracts of Japan for JP57-014499 published on Jan. 25, 1982.

* cited by examiner

*Primary Examiner*—Derris H. Banks
*Assistant Examiner*—Jimmy T. Nguyen
(74) *Attorney, Agent, or Firm*—Darby & Darby

(57) ABSTRACT

The object of this invention is to provide a mechanical press that presents no inconvenience in press operations despite its low height, providing great stability and excellent durability.

The invention comprises a slide guiding mechanism provided at an upper part of the adjusting member for converting the rotary motion of the eccentric part of the crankshaft into a linear reciprocating motion and a position adjusting mechanism provided at a lower part, as well as an adjusting member that advances and retracts relative to the slide, which serves for the prevention of rotation and guidance.

16 Claims, 10 Drawing Sheets

MECHANICAL PRESS

BACKGROUND OF THE INVENTION

1. Field of the Invention

The invention relates to a mechanical press

2. Description of the Related Art

In a typical mechanical press of the prior art, an eccentric part 8*a* of a crankshaft and a slide 3 are connected with a connecting rod 23 as shown in FIG. 10. An adjusting screw rod 24 is provided between connecting rod 23 and slide 3 for adjusting the slide. In this example of prior art, the presence of connecting rod 23 prevents the shortening of the distance between the crankshaft and slide 3, resulting in a taller mechanical press, taller by said distance.

A mechanical press without a connecting rod was proposed by Unexamined Patent Publication S55-48500. Since no connecting rod exists in said example, the height of the machine can be lowered, but it is impossible to provide an adjusting screw rod for slide adjustment making the press very inconvenient to use in press operations.

Another example of prior art is the one disclosed by Unexamined Patent Publication H06-269996. As shown in FIG. 5 of said publication, it comprises: a bush 8 and a sliding piece 9 fitted on an eccentric part 3*a* of a crankshaft 3; a connecting rod 10 that slidably contains sliding piece 9; and a guide bush 12 provided in a crown for guiding connecting rod 10 in an up and down direction, while connecting rod 10 and a slide 16 are connected via a die height adjusting mechanism 17.

According to said prior art, slide 16 cannot be raised higher than the guide part of connecting rod 10 as connecting rod 10 is guided at the crown as mentioned before. In other words, the machine height cannot be shortened any further.

Another example of prior art is the one disclosed by Unexamined Patent Publication S57-14499. As shown in FIG. 3 of said publication, a guide plate 11 is guided by guide 12. Therefore, a slide 2 cannot go any higher than guide 12, so that the distance between a crankshaft 3 and slide 2 cannot be shortened. Therefore, it is difficult to shorten the height of the machine.

As mentioned in the above, it is difficult to shorten the machine height in all of these prior art machines if there is a connecting rod or something similar to it is used. On the other hand, machines that can be built shorter in heights present inconveniences in press operations.

The invention intends to provide a mechanical press that can be built shorter in height without sacrificing convenience in press operations, while providing merits of stability and longevity.

SUMMARY OF THE INVENTION

The present invention is to have a slide guiding mechanism provided above an adjusting member for converting a rotational motion of an eccentric part of a crankshaft into a reciprocating straight line motion, a position adjusting mechanism provided below, and a device for guiding and preventing said adjusting member from rotating relative to said slide.

More specifically, one implementation of the invention is to provide: a slide guiding mechanism provided above an adjusting member for converting a rotational motion of an eccentric part of a crankshaft into a reciprocating straight line motion in coordination with a slide of the mechanical press; a position adjusting mechanism provided below said adjusting member for advancing or retracting said adjusting member relative to said slide; and a device for guiding and preventing said adjusting member from rotating relative to said slide.

Another implementation of the invention provides, in addition to the features of claim 1, wherein said device for guiding and preventing said adjusting member from rotating relative to said slide uses a spherical member that consists of a spherical part and a flat part. Another implementation the invention provides a pair of said spherical members is provided and a guide surface to which said flat part of each spherical member is contacting makes an angle to each other.

Still another implementation of the invention provides a block that contains said guide surface having its position adjusted in an axial direction of the eccentric part of the crankshaft. Another implementation of the invention provides that the spherical part engages with a concave spherical surface provided in said adjusting member, and the flat part is built into said guide surface in a slidable manner.

Another implementation of the invention provides that said spherical member engages with a concave spherical surface of a receiving member affixed to said adjusting member, and the flat part is built into said guide surface in a slidable manner. Still another implementation of the invention provides that said spherical member is affixed to said adjusting member, and is built in with a cap on the spherical part.

Another implementation of the invention provides that said block's position is adjustable by means of the eccentric pin.

DETAILED DESCRIPTION OF THE PREFERRED EMBODIMENTS

Figure 1:
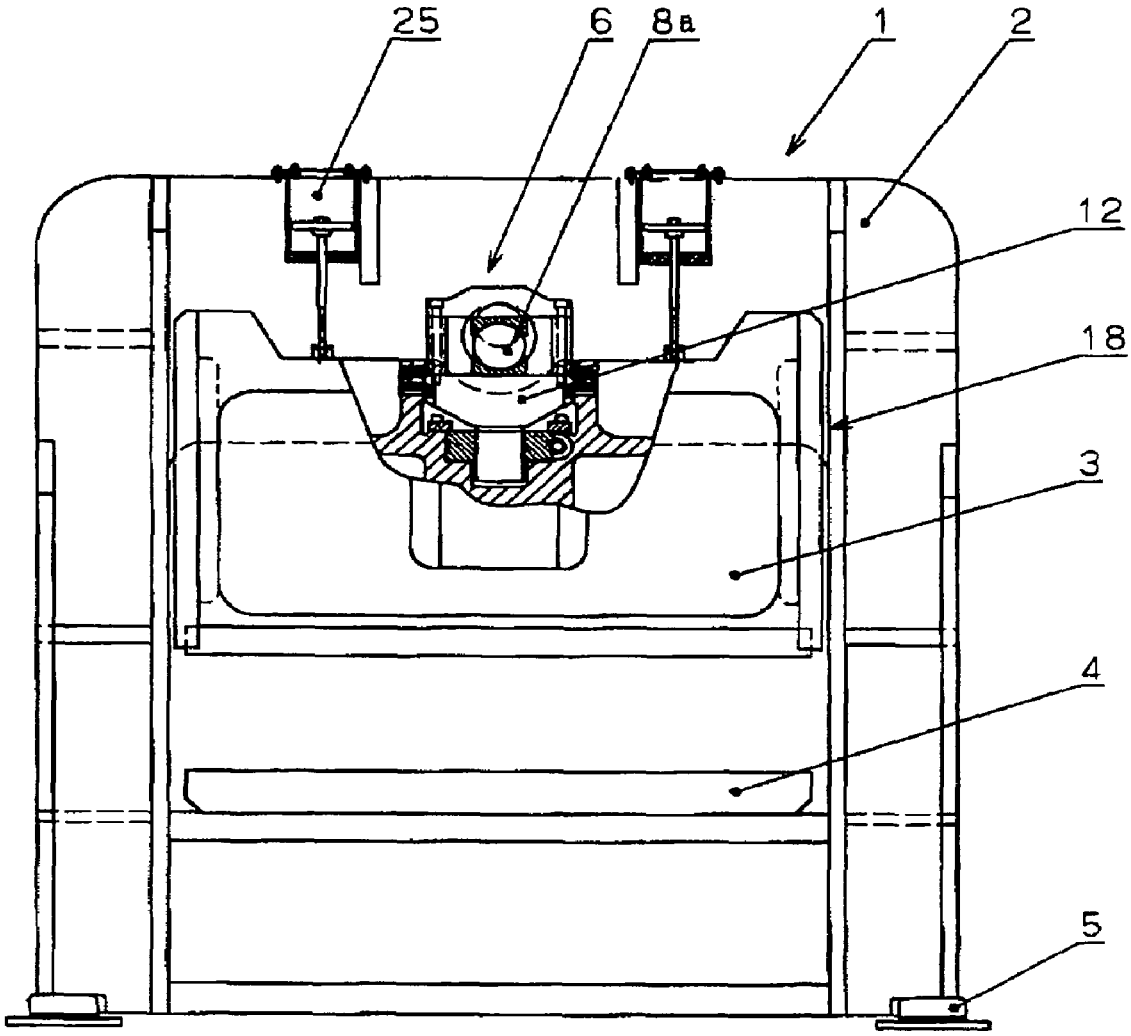
FIG. 1 is a front view and partial cross section of the press of the present invention.

In FIG. 1, a slide 3 provided on a frame 2 of a mechanical press 1 is free to move up and down, and a bolster 4 is affixed on a frame 2 facing slide 3. A vibration prevention device 5 is affixed to the lower end of frame 2 for isolating the vibration of the mechanical press from the foundation of the machine.

Slide 3 is guided for its up and down motion relative to frame 2 by means of a slide guide 18. Slide 3 is suspending from a balancer 25. Balancer 25 consists of an air cylinder, and balances the weight of slide 3 and the weight of a top die affixed to the bottom surface of slide 3.

Figure 2:
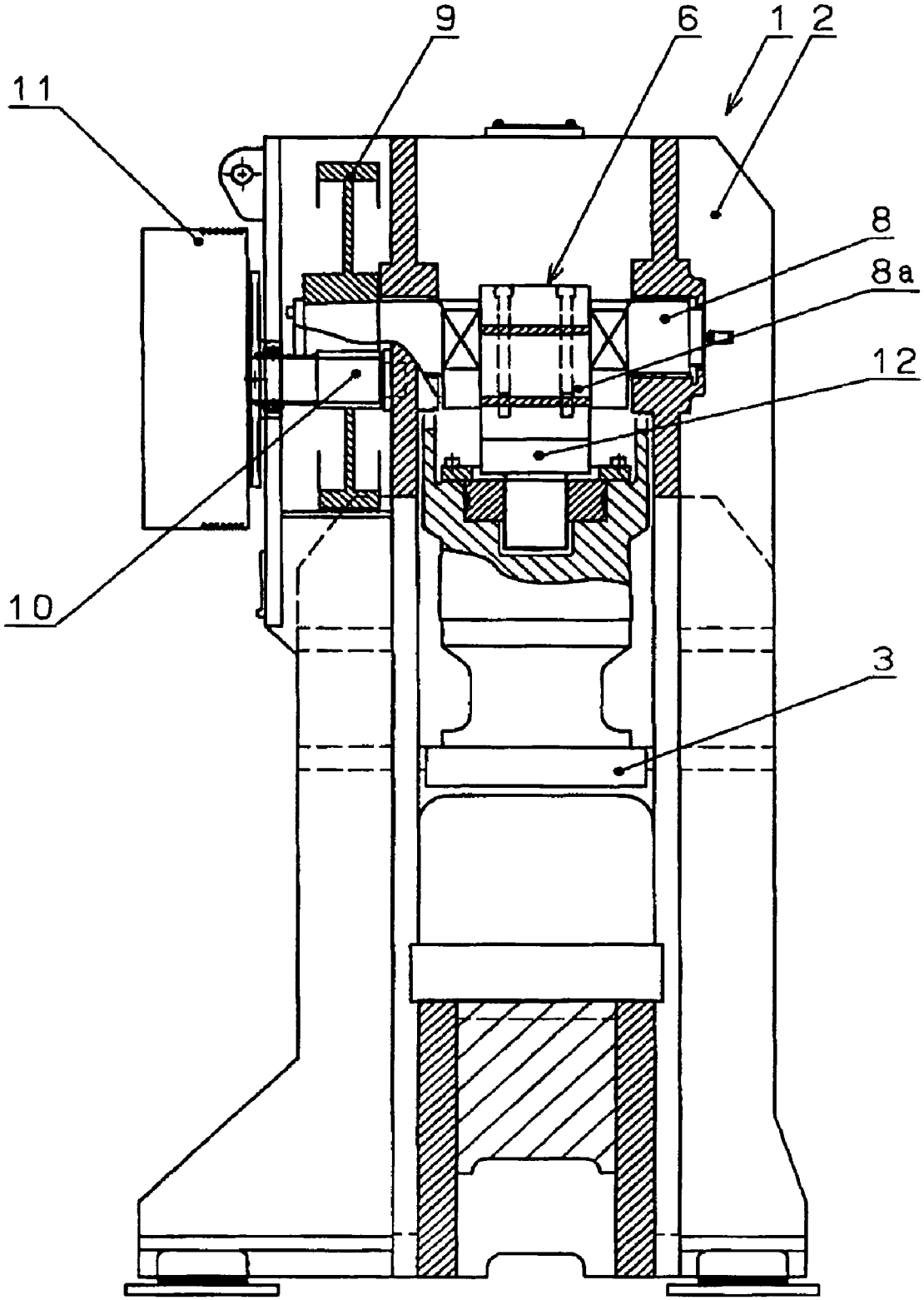
FIG. 2 is a left side view and partial cross section of the press of FIG. 1.

In FIG. 2, crankshaft 8 is supported by frame 2. Crankshaft 8 is rotatably supported by bearings provided in frame 2, and are arranged in the front to back direction relative to frame 2.

A main gear 9 is affixed to crankshaft 8. On the other hand, flywheel 11 is rotatably provided in frame 2. Flywheel 11 contains a clutch-brake and rotates driven by a motor (not shown). A pinion gear 10 is formed on a shaft on which said clutch-brake is provided. Pinion gear 10 is in mesh with said main gear 9.

Crankshaft 8 is driven by a drive mechanism comprising a motor, flywheel 11, the clutch-brake, pinion gear 10 and main gear 9. Since flywheel 11 has a relatively large diameter, it is arranged approximately in the same height as crankshaft 8 so that the height of frame 2, i.e., the height of the mechanical press 1 can be shortened.

Figure 3:
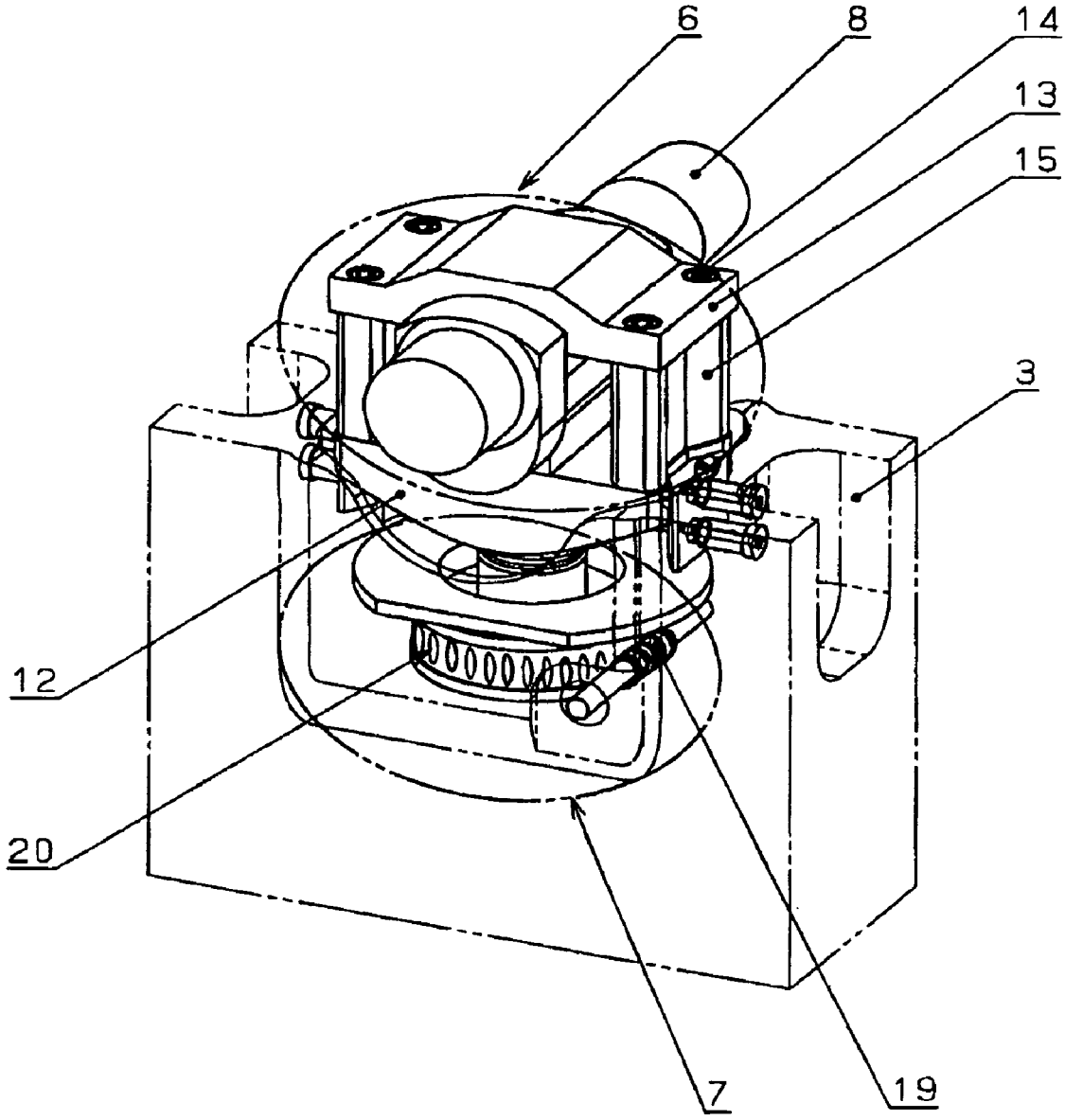
FIG. 3 is a perspective view of an adjoining member of the present invention.
Figure 4:
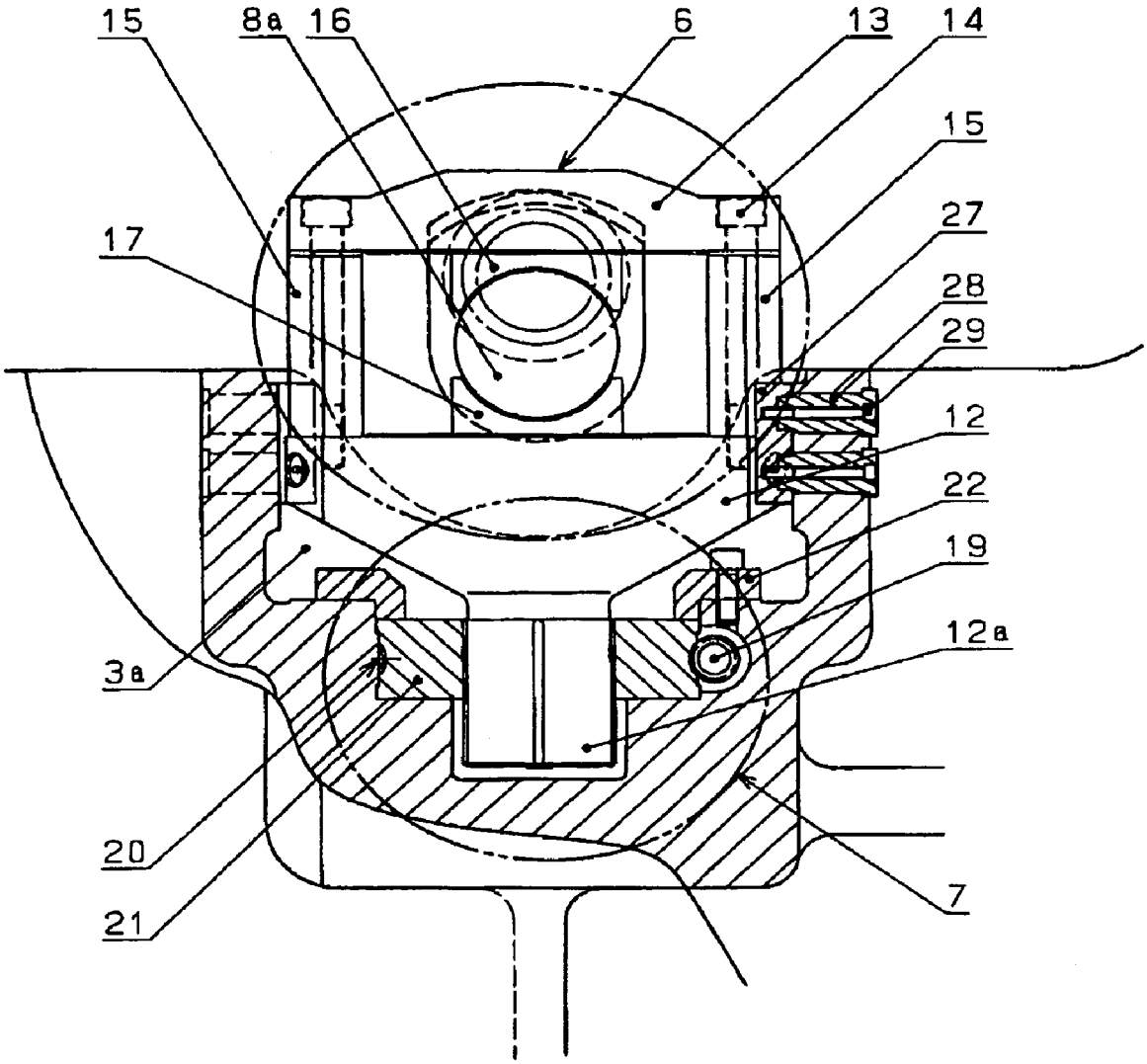
FIG. 4 is an enlarged view of the adjoining member.

Referring to FIG. 3 and FIG. 4, an adjusting member 12 and its vicinity is described in more detail. FIG. 3 is similar to FIG. 4 except that it is a perspective drawing. Slide 3 is shown only partially in FIG. 3. Both of these drawings show the system with the crank angle at 180°, slide 3 is at the bottom dead center.

A slide guiding mechanism 6 and a position adjusting mechanism 7 are provided integrally. Sliding mechanism 6 is provided above and position adjusting mechanism 7 is provided below adjusting member 12. Adjusting member 12 is covered by a cap 13, which is affixed with bolts 14 via spacers 15. Adjusting member 12, spacer 15, 15, and cap 13 for a frame that has a space in the middle.

Said space houses an eccentric part 8*a* of crankshaft 8, an upper sliding piece 16 and a lower sliding piece 17. Upper sliding piece 16 and lower sliding piece 17 engage with eccentric part 8*a* above and below respectively, while upper sliding piece 16 slides against cap 13 freely, and lower sliding piece 17 slides against adjusting member 12 freely. Slide guiding mechanism 6 consists of upper sliding piece 16, lower sliding piece 17, adjusting member 12, cap 13, spacer 15, etc.

Upper sliding piece 16 and lower sliding piece 17 move laterally relative to said frame. Upper sliding piece 16 and lower sliding piece 17 constitute a so-called split type sliding piece. The split type sliding piece has such merits that it does not need the space for bolts, which are required for binding the upper and lower sliding pieces together, so that the width of each sliding piece can be narrower, that the in and out clearance for the sliding piece can be halved, etc.

A threaded rod 12*a* is formed at the lower end of adjust member 12. A nut 21 is fitted to threaded rod 12*a*. Nut 21 is assembled into slide 3 in such a way that it is free to rotate but constrained in the vertical direction. Nut 21 is held to slide 3 with a retainer 22.

A worm gear 20 is formed on the outside of nut 21. Worm gear 20 engages with a worm shaft 19 provided rotatably in slide 3. Worm 19 is driven by a motor (not shown) to rotate. Threaded rod 12*a*, nut 21, worm gear 20, worm shaft 19, etc. constitute a position adjusting mechanism 7, which corresponds to a conventional slide adjusting mechanism.

Position adjusting mechanism 7 of this embodiment uses a screw mechanism, but the same can be constituted by a hydraulic means. In other words, it can be so constituted to provide a hydraulic cylinder underneath adjusting member 12 in order to move adjusting member 12 relative to slide 3 by means of adjusting the amount of oil. Alternatively, a tapered block can be provided underneath adjusting member 12 in order to move adjusting member 12 relative to slide 3.

In FIG. 4, when worm shaft 19 rotates, worm gear 20 and nut 21 rotate to elevate adjusting member 12 up and down by means of a screw mechanism. Thus, adjusting member 12 can move forward and backward relative to slide 3.

Adjusting member 12 is prevented from accidental rotations by means of a guiding device. In other words, said guiding device has a function of preventing the slide adjustment amount from changing caused by rotations of adjusting member 12 during press operations.

Figure 5:
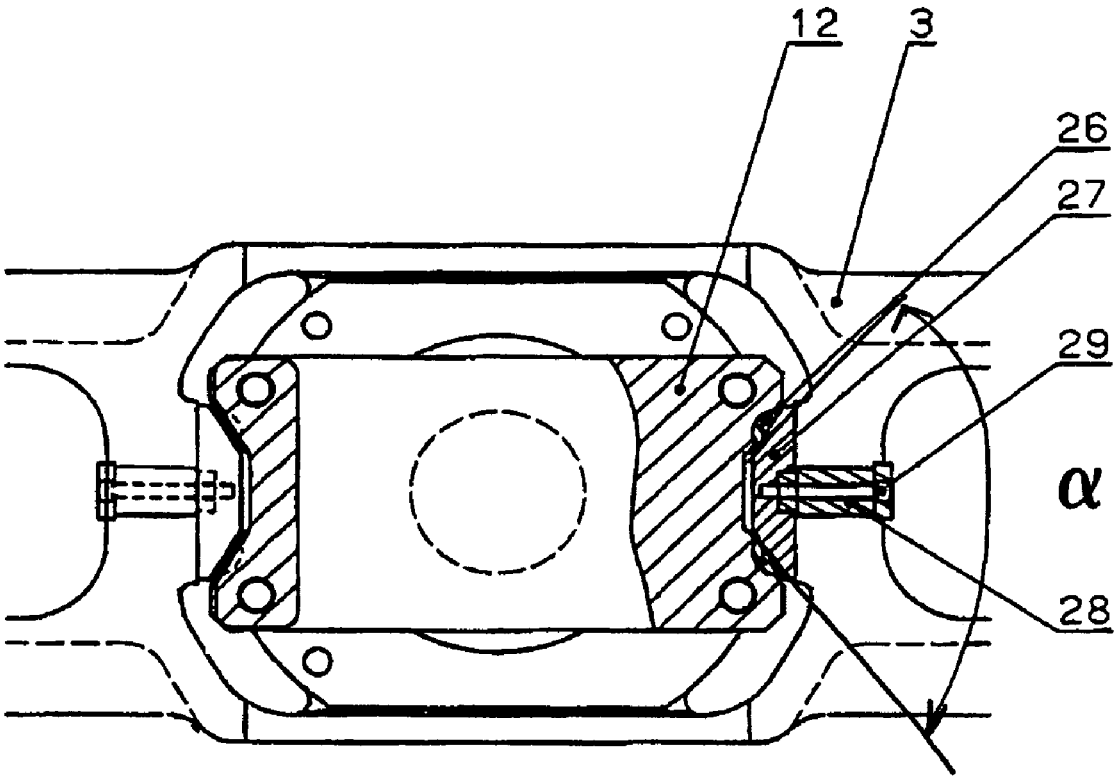
FIG. 5 is a top view of another embodiment and partial cross section.

In FIG. 4 and FIG. 5, a block 27 is built into guide hole 3*a* of slide 3. Block 27 is affixed to slide 3 by means of eccentric pins 28 and bolts 29. A spherical member 26 is located between block 27 and adjusting member 12. Spherical member 26 consists of a spherical part and a flat part and forms a part of a sphere. The height of spherical member 26 is approximately 30% of the diameter of the sphere. Spherical member 26 is stored in a cavity of a spherical shape provided in adjusting member 12 and said flat surface is contacting block 27. Block 27 has a guide surface.

In this embodiment, an angle $\alpha$ formed by the planes of contact between block 27 and the flat surfaces of a pair of spherical members 26 is 120°. The angle $\alpha$ is convex, as seen from the block 27 side. This angle is chosen based on the eccentric load acting on adjusting member 12. It is chosen on the assumption that the eccentric load in the left and right direction is greater than that in the front and back direction. If $\alpha$ is 120°, the ratio of said projected area is $\sqrt{3}$:1 due to the trigonometric relation, in other words, approximately 1.7:1.

The position of block 27 is adjustable by means of eccentric pin 28 in the forward and backward direction (the axial direction of eccentric part 8*a* of crankshaft 8). Block 27 is adjusted in order to adjust the inclination of the guiding surfaces of adjusting member 12 in the forward and backward direction relative to upper and lower sliding pieces 16 and 17 (especially sliding piece 17). In other words, it is to makes sure that the outer periphery of eccentric part 8*a* of crankshaft 3 and the inner periphery of lower sliding piece 17 as well as the bottom surface of lower sliding piece 17 and the horizontal plane (top surface) of adjusting member 12 make surface contacts respectively.

Since adjusting member 12 is affixed to slide 3 via threaded rod 12*a*, forward and backward adjustments of block 27 cause the horizontal surface (top surface) of adjusting member 12 to tilt forward and backward correspondingly.

Figure 9:
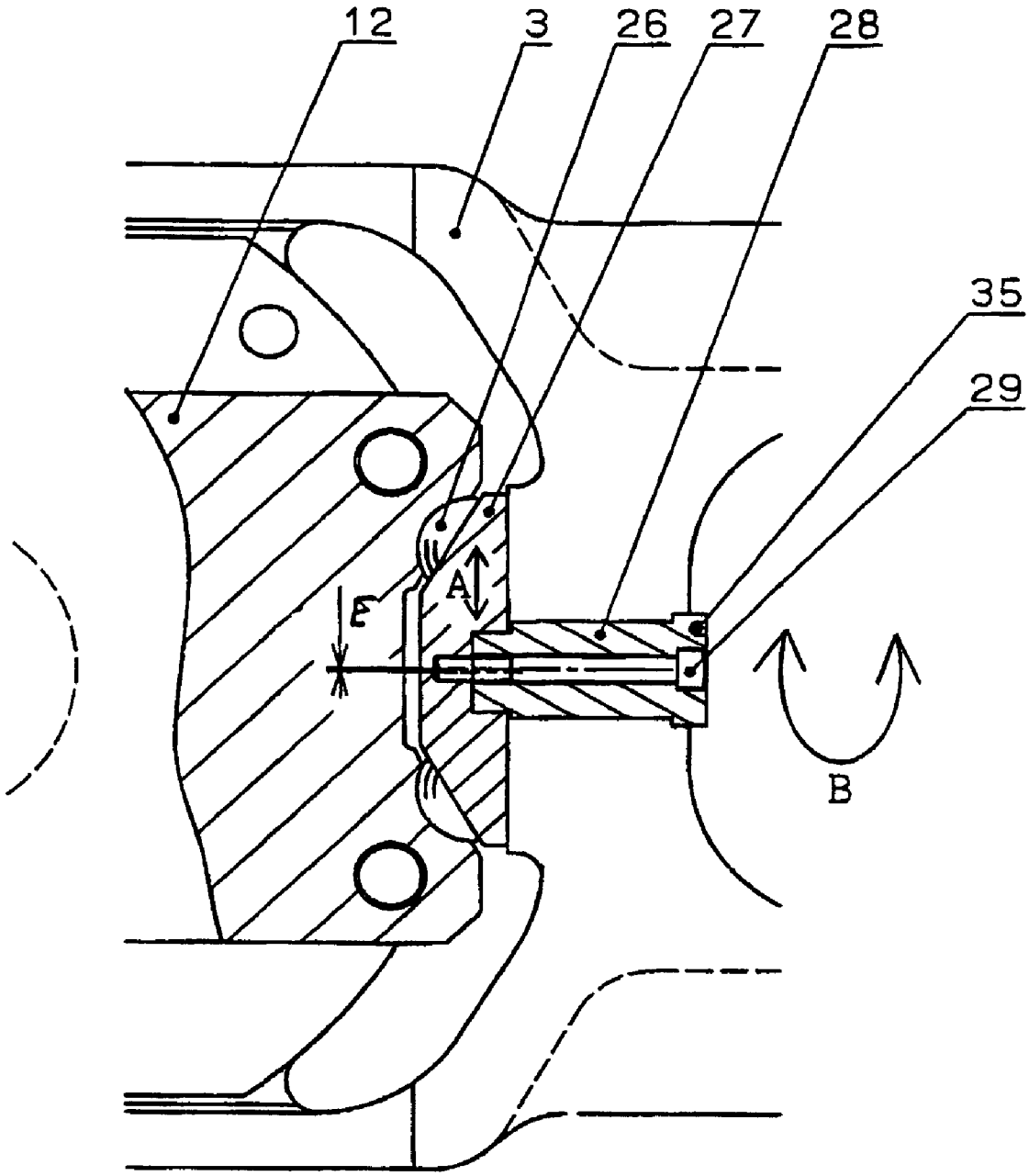
FIG. 9 is a descriptive view of the eccentric pin.
Figure 10:
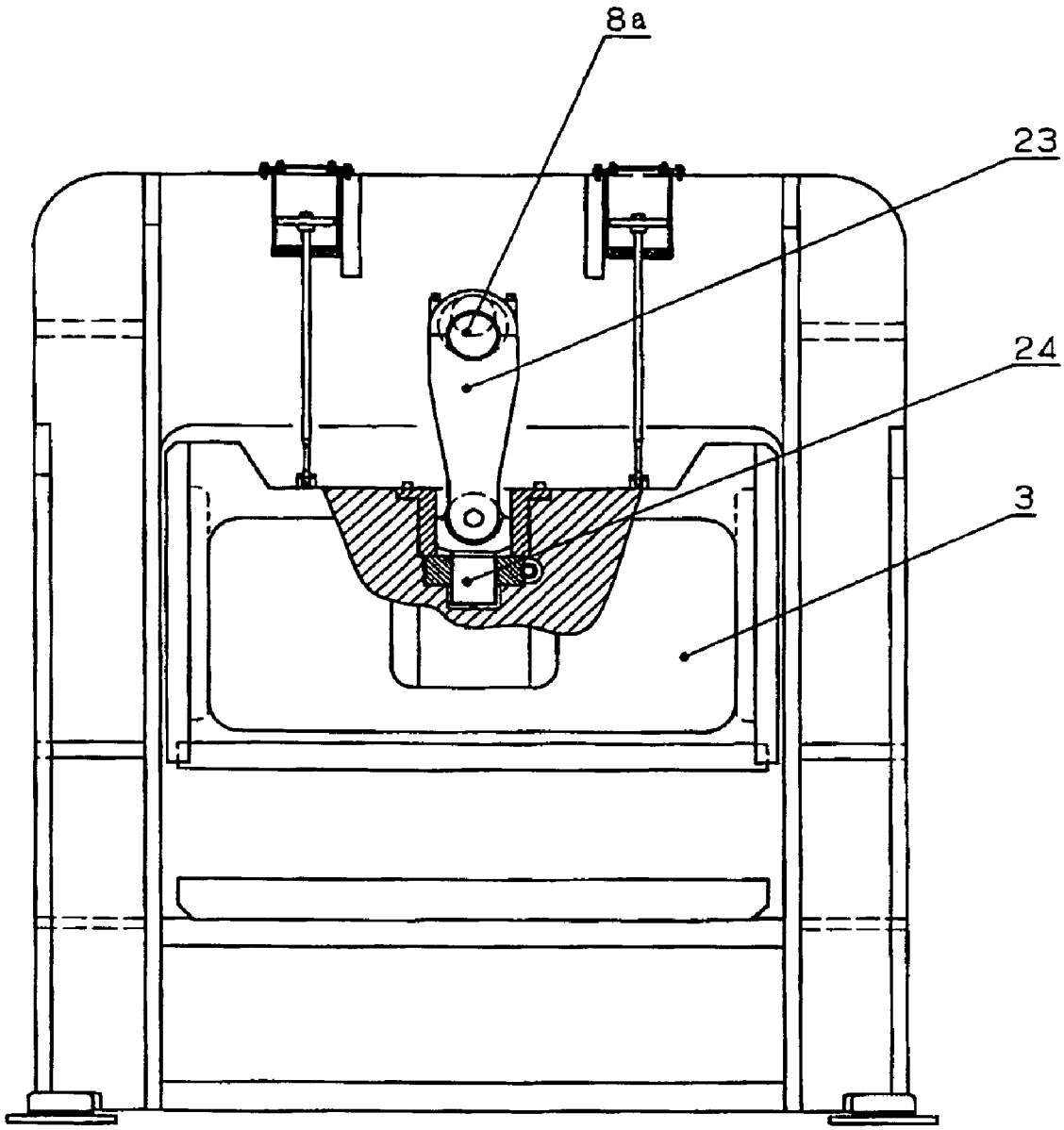
FIG. 10 is a front view of a mechanical press of prior art having a connecting rod.

In FIG. 9, the cylindrical part on the left end of eccentric pin 28 is off-centered relative to the cylindrical part on the center by an amount "E." By loosening bolt 29 slightly, engaging the special tool to a twisting hole 35 and turning eccentric pin 28 in the direction of the arrow B, block 27 moves in the direction A. After adjusting block 27, bolt 29 is tightened to affix block 27 to slide 3.

Figure 6:
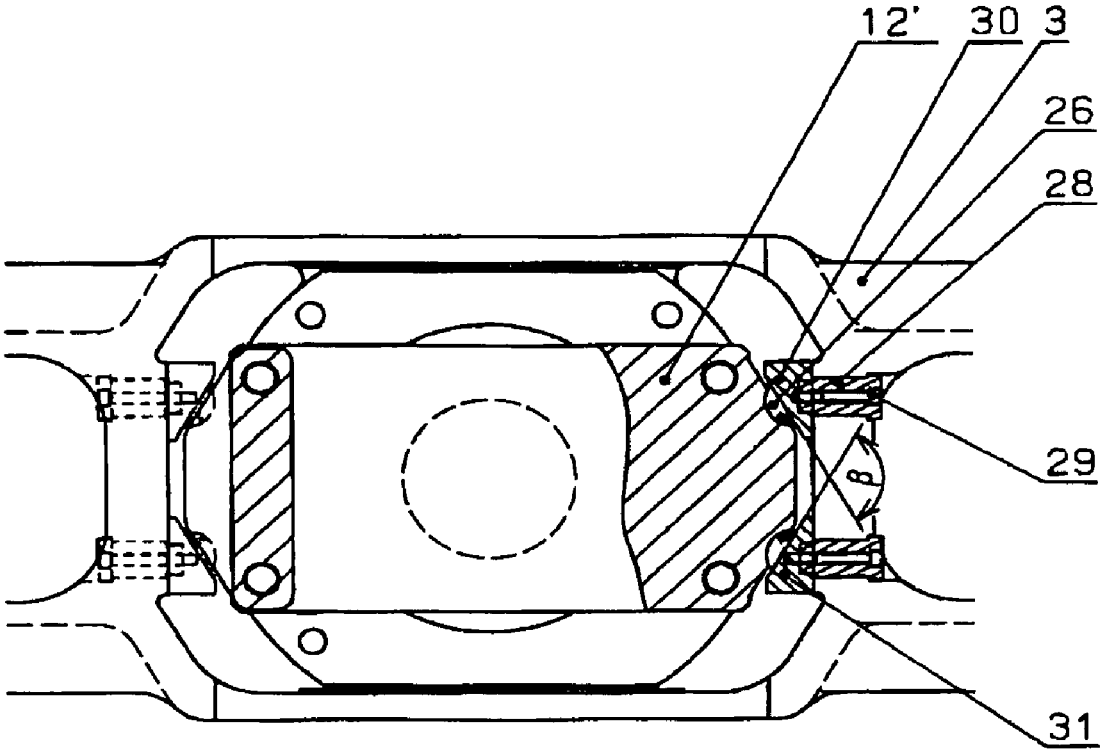
FIG. 6 is a top view and partial cross section of another embodiment of the adjoining member.

FIG. 6 shows another embodiment and corresponds to FIG. 5 mentioned above. In case of FIG. 5, the guide surfaces of a pair of spherical members 26 form the angle $\alpha$, which is convex seen from the block 27 side. On the other hand, an angle $\beta$ in case of FIG. 6 that corresponds to said angle a is concave seen from the blocks 30 and 31 side. As a result, the cross sectional shape of adjusting member 12' is convex toward blocks 30 and 31. Blocks 30 and 31 are adjustable by means of an eccentric pin 28 as in the case of said block 27.

Figure 7:
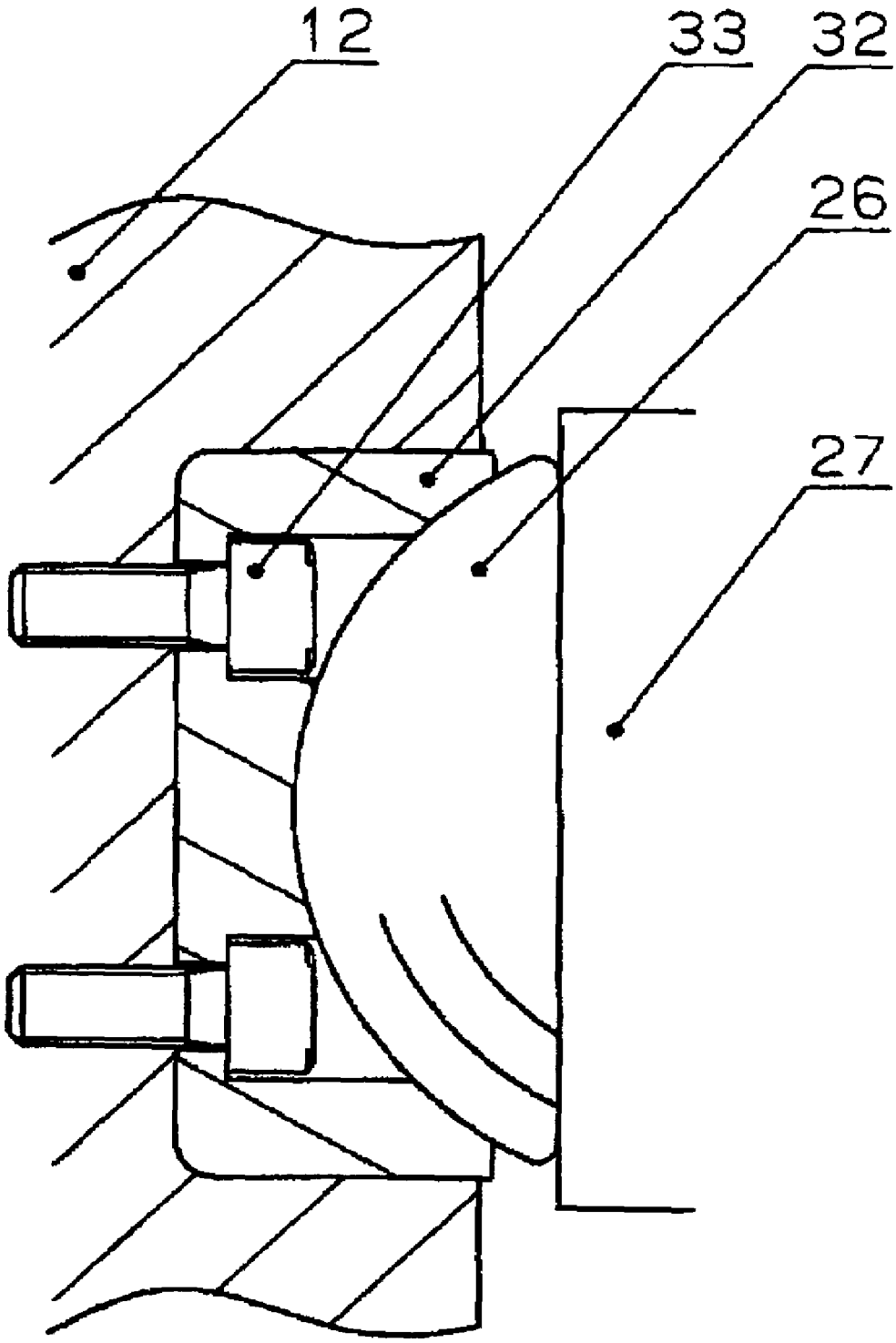
FIG. 7 is a second embodiment of the spherical member.
Figure 8:
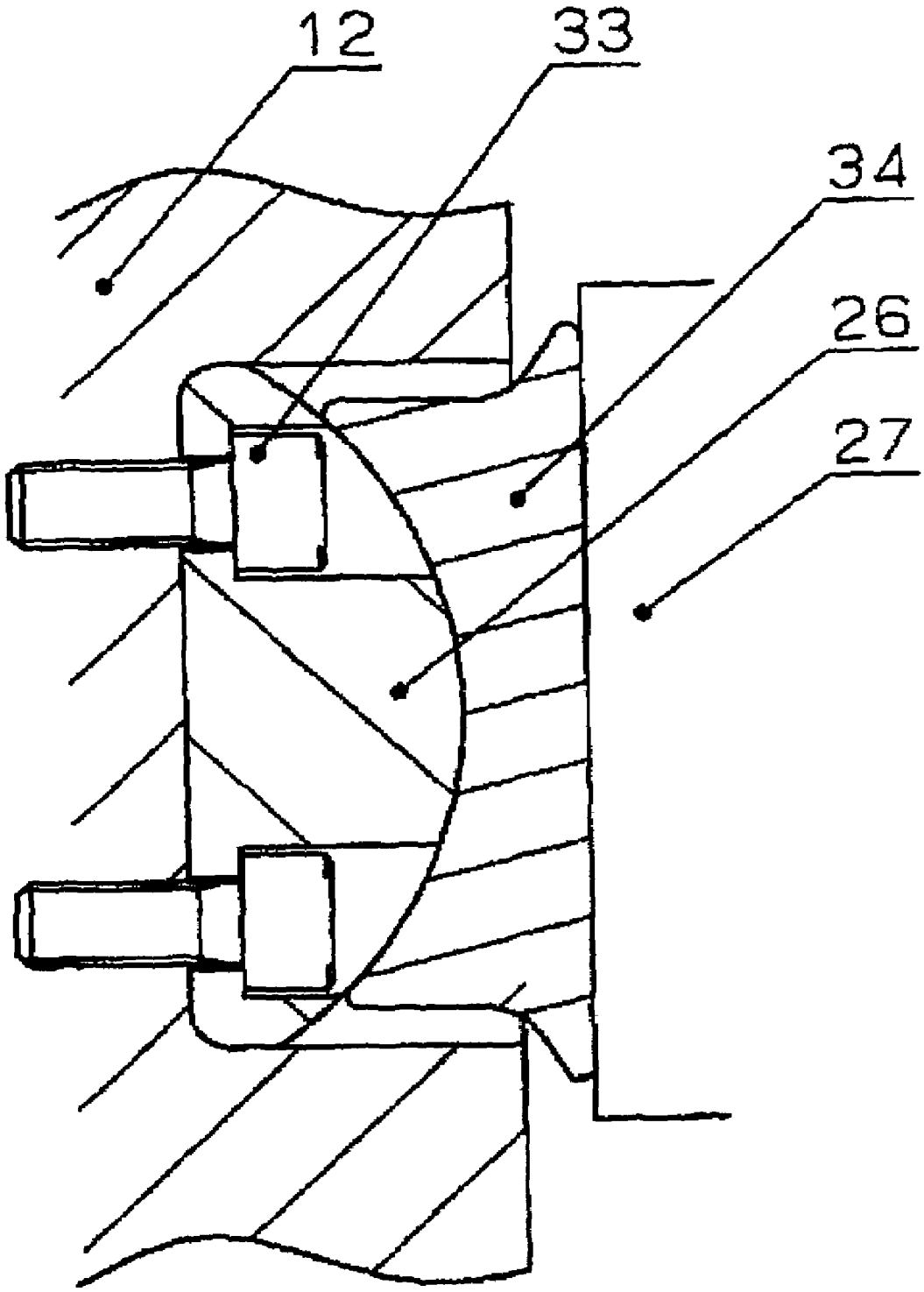
FIG. 8 is a third embodiment of the spherical member.

FIG. 7 and FIG. 8 show other embodiments with different assembling modes for spherical member 26. In case of FIG. 7, a receiving member 32 is provided on adjusting member 12, while receiving member 32 receives spherical member 26. In other words, receiving member 32 exists between spherical member 26 and adjusting member 12. Receiving member 32 is affixed to adjusting member 12 by means of bolts 33. With this structure, it is not necessary to form a concave spherical surface on adjusting member 12 and makes its machining easier.

In case of FIG. 8, a cap 34 is place on a spherical member 26' and allows the flat surface of cap 34 and block 27 to slide to each other. Cap 34 has a convex spherical surface that engages with the spherical surface of spherical member 26'. Spherical member 26' is affixed to adjusting member 12 by means of bolts 33. Spherical body 26' is housed in adjusting member 12.

Effects of the Invention

The invention makes a member that corresponds to a connecting rod unnecessary, so that it makes it possible to provide the slide at a higher position. This results in shortening the height of a mechanical press. On account of that, the rigidity in the vertical direction increases, and the rigidity in the horizontal direction increases as well. This also enables us to lower the ceiling height of the building where a mechanical press is stored and also results in the improvement of the press operation. In addition, the invention provides a mechanical press with a more stable performance and a longer longevity as adjusting member 12 is guided with a more rational guide.

What is claimed is:

1. A mechanical press comprising:

an adjusting member;

a slide guiding mechanism provided above said adjusting member;

a position adjusting mechanism provided below said adjusting member;

a slide disposed below and around said position adjusting mechanism; said position adjusting mechanism configured to advance or retract said adjusting member relative to said slide;

a crankshaft having an eccentric part which is provided to couple to said slide guiding mechanism; said slide guiding mechanism configured to convert a rotational motion of the eccentric part of the crankshaft into a reciprocating straight line motion in coordination with the slide of the mechanical press; and a device for guiding and preventing said adjusting member from rotating relative to said slide, wherein said device for guiding and preventing said adjusting member from rotating relative to said slide comprises:

a spherical member including a spherical part and a flat part.

2. A mechanical press described in claim 1, further comprising:

another spherical members, said spherical part of each spherical member coupling to the adjusting member; and a block containing a guide surface for contacting said flat part of each spherical member, wherein the flat part of one spherical member and the flat part of the other spherical member are configured to form an angle defined by planes of contact between said guide surface and said flat part.

3. A mechanical press described in claim 2, wherein said block containing said guide surface is adjustable in an axial direction of the eccentric part of the crankshaft.

4. A mechanical press described in claim 2, wherein the spherical part engages with a concave spherical surface provided in said adjusting member, and the flat part is built into said guide surface in a slidable manner.

5. A mechanical press described in claim 3, wherein the spherical part engages with a concave spherical surface provided in said adjusting member, and the flat part is built into said guide surface in a slidable manner.

6. A mechanical press described in claim 2, wherein said spherical member engages with a concave spherical surface of a receiving member affixed to said adjusting member, and the flat part is built into said guide surface in a slidable manner.

7. A mechanical press described in claim 3, wherein said spherical member engages with a concave spherical surface of a receiving member affixed to said adjusting member, and the flat part is built into said guide surface in a slidable manner.

8. A mechanical press described in claim 3, wherein said spherical member is affixed to said adjusting member, and includes a cap on the spherical part.

9. A mechanical press described in claim 3, wherein said block is adjustable by means of an eccentric pin.

10. A mechanical press described in claim 4, wherein said block is adjustable by means of an eccentric pin.

11. A mechanical press described in claim 5, wherein said block is adjustable by means of an eccentric pin.

12. A mechanical press described in claim 6, wherein said block is adjustable by means of an eccentric pin.

13. A mechanical press described in claim 7, wherein said block is adjustable by means of an eccentric pin.

14. A mechanical press described in claim 8, wherein said block is adjustable by means of an eccentric pin.

15. A mechanical press comprising:

an adjusting member;

a slide guiding mechanism provided above said adjusting member;

a position adjusting mechanism provided below said adjusting member;

a slide disposed below and around said position adjusting mechanism; said position adjusting mechanism configured to advance or retract said adjusting member relative to said slide;

a crankshaft having an eccentric part which is provided to couple to said slide guiding mechanism; said slide guiding mechanism configured to convert a rotational motion of the eccentric part of the crankshaft into a reciprocating straight line motion in coordination with the slide of the mechanical press; and a device for guiding and preventing said adjusting member from rotating relative to said slide;

wherein said device for guiding and preventing said adjusting member from rotating relative to said slide comprises;

a spherical member including a spherical part and a flat part;

a cap disposed over the spherical part of the spherical member; and a block member slidably coupled to the spherical member through the cap, wherein said spherical member is affixed to said adjusting member from the flat part of the spherical member.

16. A mechanical press described in claim 15, wherein said block is adjustable by means of an eccentric pin.

* * * * *